US005341562A

United States Patent [19]

Furuya et al.

[11] Patent Number: 5,341,562

[45] Date of Patent: Aug. 30, 1994

[54] METHOD FOR PREVENTING CORROSION OF A REINFORCED CONCRETE STRUCTURE

[75] Inventors: Akio Furuya; Toshimoto Tsuji; Takayuki Sato, all of Yokohama, Japan

[73] Assignee: DAI Nippon Toryo Co., Ltd., Osaka, Japan

[21] Appl. No.: 51,655

[22] Filed: Apr. 26, 1993

[30] Foreign Application Priority Data

Apr. 27, 1992 [JP] Japan ..... 4-107294
Jun. 16, 1992 [JP] Japan ..... 4-156760

[51] Int. Cl.[5] ..... H01R 43/00

[52] U.S. Cl. ..... 29/825; 209/147; 209/196

[58] Field of Search ..... 204/147, 196; 29/825

[56] References Cited

U.S. PATENT DOCUMENTS 4,255,241 3/1981 Kroon et al. ..... 204/196 X
4,506,485 3/1985 Apostolos .
4,692,066 9/1987 Clear ..... 204/196 X
5,228,459 7/1993 Miller ..... 204/147 X

FOREIGN PATENT DOCUMENTS 02750838 7/1988 European Pat. Off. .
55-76088 6/1980 Japan .
2140456 11/1984 United Kingdom ..... 204/196

OTHER PUBLICATIONS

Patent Abstracts of Japan, vol. 015, No. 421 (C-0878), Oct. 25, 1991, JP-A-03 174 379, Jul. 29, 1991.
Database WPI, Derwent Publications Ltd., AN 89-104596, JP-A-1 052 051, Feb. 28, 1989.
Database WPI, Derwent Publications Ltd., AN 83-49758K, JP-A-57 168 959, Oct. 18, 1982.

*Primary Examiner*—Carl J. Arbes
*Attorney, Agent, or Firm*—Oblon, Spivak, McClelland, Maier & Neustadt

[57] ABSTRACT

A method for preventing corrosion of a reinforced concrete structure having a reinforcing steel embedded therein, which comprises coating an aggregate-containing primer on the surface of the reinforced concrete structure, to form a primer layer having a rough surface, metal-spraying a metal having an ionization tendency larger than iron on the primer layer to form a metal spray coating layer, and connecting the metal spray coating layer and the reinforcing steel by an electrically conductive material.

5 Claims, 1 Drawing Sheet

METHOD FOR PREVENTING CORROSION OF A REINFORCED CONCRETE STRUCTURE

The present invention relates to a method for preventing corrosion of a reinforced concrete structure. Particularly, it relates to a method for preventing corrosion of a reinforced concrete structure, which provides an excellent corrosion preventive property whereby the reinforcing steel of the reinforced concrete structure can be protected effectively from corrosion for a long period of time.

Concrete structures usually have reinforcing steels embedded therein. Such reinforcing steels are likely to be corroded as a result of carbonation of concrete or by an influence of a salt content contained in the material for concrete or by an influence of chlorine ions or sulfuric acid ions contained in water penetrated into the concrete. Thus, the reinforcing steels of concrete structures had a drawback that the function as a reinforcing material was lost in a relatively short period of time. To prevent corrosion of reinforcing steels, it was common to employ (a) a method of coating a corrosion preventive paint on the surface of a concrete structure, (b) a method for electrolytic protection (cathodic protection) by means of an impressed current method, or (c) a method for electrolytic protection (cathodic protection) by means of a galvanic anode method.

However, (a) the method of coating a corrosion preventive paint on the surface of a concrete structure had a drawback that the coating film formed by the corrosion preventive paint did not have adequate physical strength, and it was susceptible to damages. As a consequence, corrosive factors tended to penetrate through the damaged portions, whereby the coating film was inferior in the corrosion prevention for a long period of time.

Whereas, (b) the method for electrolytic protection by means of an impressed current method was excellent in the corrosion prevention for a long period of time, but it had a drawback that special apparatus such as a power source apparatus and a monitoring apparatus were required, and periodical inspections had to be conducted, whereby running costs including labor costs in addition to the installation costs and the power costs were substantial.

Whereas, (c) the method for electrolytic protection by means of a galvanic anode method requires no such specific apparatus, and the maintenance is simple. Further, this method is excellent in providing corrosion prevention for a long period of time. Thus, an attention has been drawn to this method.

Typical embodiments of this galvanic anode method include (i) an in-kerf laying method wherein a kerf is formed on the surface of a concrete structure, then a zinc ribbon is laid in the kerf and finally mortar or concrete is filled in the kerf, (ii) an in-kerf laying and coating method, as an improvement of the method (i), wherein the zinc ribbon laid in the kerf is coated by electrically conductive mortar or electrically conductive polymer cement mortar for the purpose of conducting a corrosion preventive current uniformly, (iii) a zinc plate-attaching method wherein mortar is laid on the surface of a concrete structure, then a zinc plate having a number of perforations is laid thereon before the mortar cures and finally concrete is covered thereon, and (iv) a galvanic anode material-attaching method wherein a material having a protective plate such as a flexible plate, a water proofing material such as a rubber asphalt sheet, a galvanic anode plate such as a zinc plate and a water retention material such as a water retention back-filling material integrally laminated sequentially from outside, is attached to the surface of a concrete structure by a fixing means (e.g. Japanese Unexamined Patent Publications No. 199784/1987 and No. 209494/1990). However, each of these methods has drawbacks such that application to a vertical surface, a ceiling surface, a complex-shaped portion or a narrow portion is difficult, and the workability is poor. Further, the in-kerf laying method (i) has a drawback that an adequate corrosion preventive current is hardly obtainable, since the surface area of the zinc ribbon against an application area is insufficient. The in-kerf laying and coating method (ii) has a drawback that the adhesion between the conductive secondary electrode made of e.g. the conductive polymer cement mortar and the concrete surface and/or the zinc ribbon tends to deteriorate, and blistering or peeling of the conductive secondary electrode is likely to result, whereby it is difficult to conduct a corrosion preventive current uniformly for a long period of time. The zinc plate-attaching method (iii) has a drawback that the adhesion of the mortar covered on the zinc plate is inadequate, and when a repair work is to be conducted, the operation tends to be of a large scale. The galvanic anode material-attaching method (iv) has a drawback from a practical operational viewpoint in that it is difficult to cut or adjust the galvanic anode material to the size of the concrete structure at site.

Further, as a method for corrosion prevention of a steel plate, a corrosion-preventing method is known wherein an aggregate-containing primer is coated on the surface of a steel plate to form a primer layer having a rough surface, and a metal is metal-sprayed onto the primer layer to form a spray coating layer, for example, in U.S. Pat. No. 4,971,838 or EP 0275083. This corrosion preventing method is capable of effectively protecting the steel plate from corrosion, since a corrosion-preventing film is formed directly on the surface of the steel plate. However, in the case of a reinforced concrete structure, a reinforcing steel is embedded in concrete, and it is impossible by the above corrosion preventing method to effectively protect the reinforcing steel from corrosion, since a corrosion preventing film can not directly be formed on such a reinforcing steel.

It is an object of the present invention to provide a method for corrosion prevention of a reinforced concrete structure, whereby excellent corrosion prevention can be provided for a long period of time efficiently even to a portion having a complex shape, a vertical surface or a ceiling surface of the reinforced concrete structure.

The present inventors have studied the above-mentioned problems inherent to the galvanic anode method and conducted a research to develop a method for preventing corrosion or a reinforced concrete structure for a long period of time, which is excellent workability, while effectively utilizing the feature of the electrolytic protection by the galvanic anode method. As a result, the present invention has been accomplished.

According to the first aspect, the present invention provides a method for preventing corrosion of a reinforced concrete structure having a reinforcing steel embedded therein, which comprises coating an aggregate-containing primer on the surface of the reinforced concrete structure, to form a primer layer having a rough surface, metal-spraying a metal having an ionization tendency larger than iron on the primer layer to form a metal spray coating layer, and connecting the metal spray coating layer and the reinforcing steel by an electrically conductive material.

According to the second aspect, the present invention provides a method for preventing corrosion of a reinforced concrete structure having a reinforcing steel embedded therein, which comprises coating an aggregate-containing primer on the surface of the reinforced concrete structure, to form a primer layer having a rough surface, metal-spraying aluminum or an aluminum alloy on the primer layer to form a metal spray coating secondary electrode layer, forming a primary electrode layer of zinc, a zinc alloy or a zinc-aluminum pseudo alloy at least partially on the secondary electrode layer, and connecting the secondary electrode layer and the reinforcing steel by an electrically conductive material.

Figure 1:
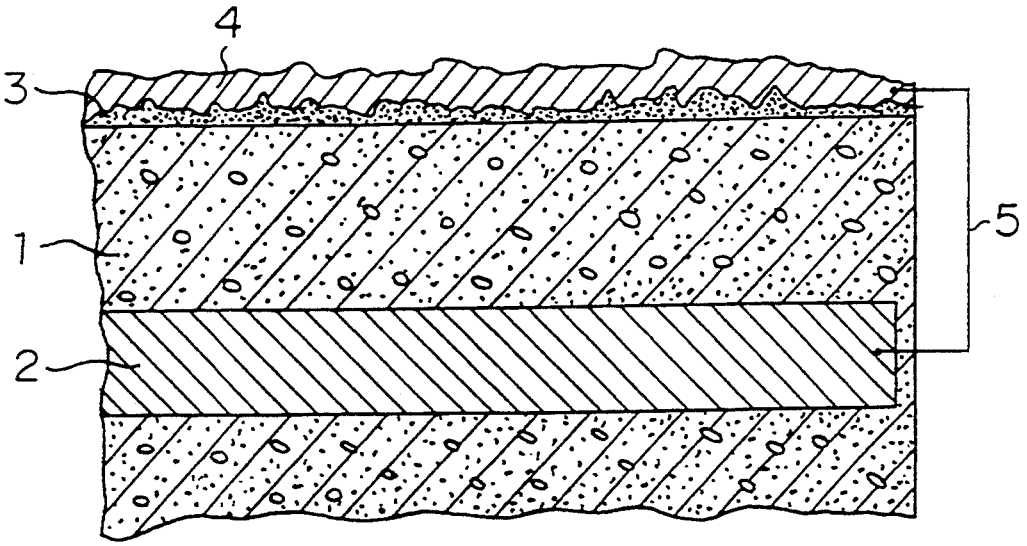
FIG. 1 is a cross-sectional view of a part of a reinforced concrete structure to which corrosion-preventing treatment was applied by the method according to the first aspect of the present invention.

Now, the present invention will be described in detail with reference to the preferred embodiments.

The primer to be used in the first and second aspects of the present invention is a primer comprising an aggregate and a binder as essential components and having a solvent (or a dispersion medium), a pigment or various additives incorporated as the case requires.

The aggregate to be used in the present invention has an average particle size of from about 10 to about 200 μm, preferably from 30 to 100 μm and is the one capable of forming sharp irregularities on the surface of the primer layer.

The aggregate in the present invention may, for example, be a metal or alloy having the same ionization tendency as the metal to be sprayed, or various metals or alloys having insulation treatment applied at least to their surface, or their oxides (such as aluminum oxide or iron oxide), nitrides or carbides. Further, silicon oxide, silicon carbide, boron nitride or a plastic powder insoluble to a solvent in the primer, may, for example, be mentioned. The amount of such an aggregate to be incorporated, is usually from about 30 to 300 volume %, preferably from 65 to 150 volume %, to the binder, and usually from about 25 to 75%, preferably from 40 to 60% as the pigment volume concentration (PVC). By the aggregate contained in the primer, the surface of the primer layer formed on the concrete structure can be made to have a suitable surface roughness, preferably at a level of a surface roughness (Rz) of from about 40 to 150 μm as prescribed in JIS B 0601. By this surface roughness, it is possible to form a spray coating film excellent in the adhesion on the surface of the reinforced concrete structure without conducting blast treatment.

The binder to be used in the present invention is not particularly limited so long as it is excellent in the drying property, water resistance and adhesion. Conventional binders for coating materials may be used without any particular restriction. For example, one-pack air drying type resin such as chlorinated rubber, an alkyd resin or a vinyl resin, or a two-package type resin (to be used in combination with a curing agent) such as an epoxy resin, an unsaturated polyester resin, an acrylurethane resin or a polyester-urethane resin, may be mentioned. In the present invention, a two-pack type epoxy resin excellent in water resistance and adhesion is particularly preferred.

Further, the solvent (or the dispersion medium) to be used as the case requires, may, for example, be a usual organic solvent for a coating material, such as xylene, toluene, butanol, methyl ethyl ketone or butyl acetate, or water. The pigment may, for example, be a filler such as barium sulfate, calcium carbonate or talc, or a coloring pigment such as titanium oxide or carbon black. The additives include a foam-preventing agent, an anti-sagging agent and a dispersant. It is preferred to incorporate from 0 to 50 wt. % of the solvent and from 0 to 30 wt. % of the pigment, based on the weight of the primer.

The primer to be used for coating may be of any type such as an organic solvent type, an aqueous type or a liquid non-solvent type.

The metal to be metal-sprayed onto the primer layer according to the first or second aspect of the present invention is not particularly limited, so long as it has an ionization tendency larger than iron. Commonly useful metals include, for example, zinc, a zinc alloy, aluminum, an aluminum alloy, copper and a copper alloy. Here, the zinc alloy is an alloy containing Zn as the main component and having at least one metal selected from e.g. Al, Cu, Mg, Fe, Cd and Si incorporated. Likewise, the aluminum alloy is an alloy containing Al as the main component and having at least one metal selected from e.g. Zn, Mg, Cr, Si, Fe, Ni and Sn incorporated. The copper alloy is an alloy containing Cu as the main component and having at least one metal selected from e.g. Ni, Zn, Sn and Al incorporated.

Further, according to the first aspect of the present invention, it is preferred to form a spray coating layer from a zinc-aluminum pseudo alloy with Zn/Al=90/10 to 50/50 (weight ratio), since the spray coating layer made of the zinc-aluminum pseudo alloy is excellent in the corrosion preventing property and has high cohesive strength, and it is highly dense and scarcely susceptible to blistering. This zinc-aluminum pseudo alloy means a state wherein zinc and aluminum do not form an alloy tissue, and fine zinc particles and fine aluminum particles are overlaid on one another in a non-uniform fashion to present an apparent appearance of a zinc-aluminum alloy. The spray coating film of this zinc-aluminum pseudo alloy can be formed by conducting arc metal-spraying by a low temperature metal-spraying method such as an arc metal-spraying method under reduced pressure.

In the second aspect of the present invention, aluminum or an aluminum alloy is used as the material for the spray coating film constituting the secondary electrode layer.

The aluminum alloy may, for example, be an alloy containing at least 50% by weight of aluminum and having at least one metal selected from e.g. Zn, Cr, Si, Fe, Ni, Mg and Sn incorporated.

The formed aluminum spray coating film has a function of conducting a corrosion preventive current as a secondary electrode and at the same time serves to protect the concrete surface, since the surface of aluminum itself will be oxidized to form a stable coating film. Further, the aluminum oxide formed on the surface is stable, and such a secondary electrode layer is scarcely corroded or worn out and thus is capable of conducting a corrosion preventive current uniformly for a long period of time.

The primary electrode layer formed at least partially on the secondary electrode layer, will be formed by zinc, a zinc alloy or a zinc-aluminum pseudo alloy. This zinc alloy may, for example, be an alloy containing at least 50% by weight of zinc and having at least one metal selected form e.g. Al, Cu, Mg, Fe, Cd and Si incorporated. The zinc-aluminum pseudo alloy may, for example, be the same as described above.

To form the primary electrode layer of zinc, a zinc alloy or a zinc-aluminum pseudo alloy partially on the surface of the secondary electrode layer, it is preferred to adhere a conventional plate made of zinc or a zinc alloy, or to metal-spray zinc, a zinc alloy or a zinc-aluminum pseudo alloy partially. When the primary electrode layer is to be formed by a plate, a plate of zinc or a zinc-aluminum alloy is preferred. When metal-spraying is to be conducted, zinc or a zinc-aluminum pseudo alloy is preferred. Especially a primary electrode layer made of a zinc-aluminum pseudo alloy has merits that it is excellent in the corrosion preventing property, has high cohesive strength and is highly dense, whereby blistering or the like scarcely occurs.

FIG. 1 is a cross-sectional view of a characteristic part of a typical reinforced concrete structure to which corrosion preventing treatment was applied by the method according to the first aspect of the present invention. Referring to this Figure, the method for preventing corrosion of a reinforced concrete structure of the present invention will be described.

The surface of a concrete structure 1 having a reinforcing steel 2 embedded as a reinforcing material, is cleaned to remove deposits such as dusts or oils, as the case requires. Then, the above-mentioned primer is coated thereon and dried to form a primer layer 3. Coating of the primer is conducted by a conventional coating method such as spraying, brush coating or roller coating. The coating amount is adjusted to be usually from about 20 to 400 $g/m^2$, preferably from 40 to 200 $g/m^2$.

Heretofore, in order to improve the adhesion of the spray coating metal film, it has been common to adopt a method wherein the surface of the substrate to be metal sprayed is subjected to blast treatment to make a rough surface. However, if this blast treatment is applied to the surface of a concrete structure, a dust will be formed, and the working environment and surrounding environment will be thereby polluted. Further, the surface hardness of the concrete structure is relatively low as compared with e.g. steel material, and aggregate material of concrete is likely to fall off from the surface, whereby it is hardly possible to obtain such a sharp roughened surface as is obtainable by the blast treatment of a steel surface, and consequently it has been impossible to form a metal spray coating film excellent in the adhesion. According to the present invention, this problem has been overcome by coating an aggregate-containing primer instead of conducting such blast treatment. On the semi-dried or completely dried primer layer 3. Thus obtained, a metal having an ionization tendency larger than iron, i.e. a metal to be electrically decomposed and corroded in place of iron, is metal-sprayed to form a spray coating layer 4.

As the method of metal-spraying a metal, a gas flame-spraying method, an electrical arc spraying method or a low temperature metal-spraying method by means of a reduced pressure arc spraying machine may be mentioned. In the present invention, any one of these methods may be employed. In a case where the primer layer is likely to be burned out if the temperature of sprayed metal particles is high, or in a case where the above-mentioned zinc-aluminum pseudo alloy is to be formed, it is preferred to employ a low temperature metal-spraying method by a reduced pressure arc spraying machine as disclosed in e.g. Japanese Examined Patent Publication No. 24859/1972 or Japanese Unexamined Patent Publication No. 167472/1986.

This low temperature metal-spraying method by means of a reduced pressure arc spraying machine is a method wherein a metal wire material is continuously electrically arc-melted under an environment where the central portion is depressurized than the peripheral portion by means of a low temperature air stream jetted in a cylindrical shape, and at the same time, the melted metal is suctioned into a forward jet stream, pulverized and quenched, whereupon the metal particles in a super cooled liquid state are sprayed on the primer layer.

The thickness of the metal spray coating layer formed on the primer layer is usually from 100 to 3,000 μm, preferably from 130 to 1,000 μm. The metal spray coating layer 4 thus formed and the reinforcing steel 2 will then be connected by an electrically conductive material 5 having the surface coated with an insulating material, whereby the metal spray coating layer 4 serves as a galvanic anode, and the reinforcing steel 2 is electrically protected from corrosion. The conductive material to be used in the present invention is not particularly limited so long as it is capable of connecting the conductive material 5 and the reinforcing steel 2 is an electrically conductive fashion. A lead wire may, for example, be employed.

Figure 2:
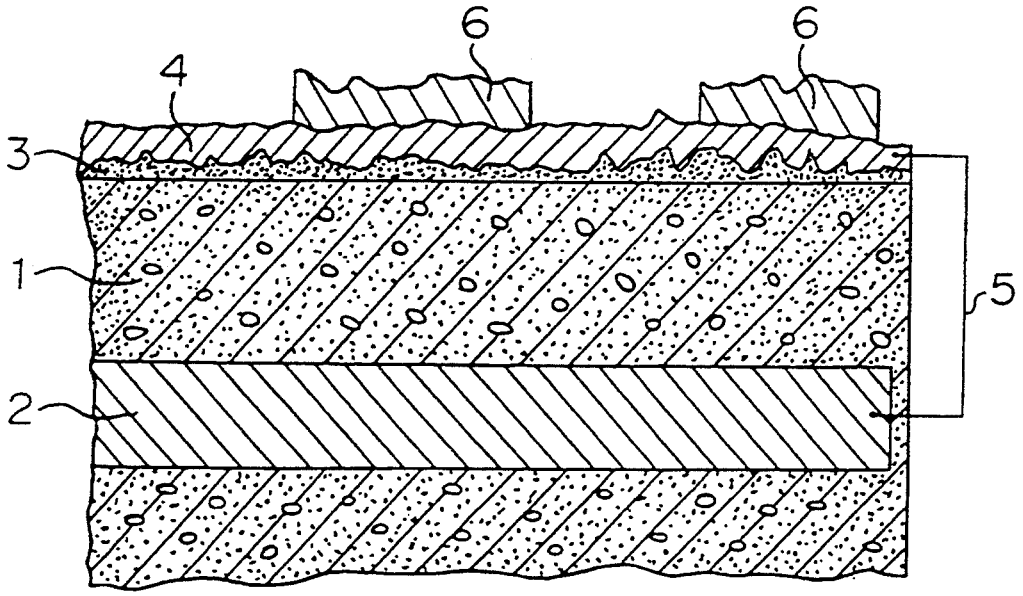
FIG. 2 is a cross-sectional view of a part of a concrete structure to which corrosion-preventing treatment was applied by the method according to the second aspect of the present invention.

FIG. 2 is a cross-sectional view of a characteristic part of a typical reinforced concrete structure to which corrosion preventing treatment was applied by the method in accordance with the second aspect of the present invention. Referring to this Figure, the method for preventing corrosion of a reinforced concrete structure according to the second aspect of the present invention will be described.

The surface of a concrete structure 1 having a reinforcing steel 2 embedded as a reinforcing material is cleaned to remove deposits such as dusts or oils, as the case requires. Then, a primer layer 3 is formed in the same manner as in the case of the first aspect of the present invention. Then, aluminum or an aluminum alloy is metal-sprayed onto the primer layer 3 in the same manner as in the case of the first aspect of the invention, to form a secondary electrode layer 4.

The thickness of the secondary electrode layer 4 made of an aluminum spray coating film formed on the primer layer 3, can be optionally determined, but is preferably from about 20 to 200 μm, more preferably from 30 to 100 μm. The secondary electrode layer made of aluminum tends to be hardly worn out since a stable aluminum oxide coating film will be formed on the surface. Accordingly, it is unnecessary to increase the thickness of the secondary electrode layer, and an adequate corrosion preventing effect can be obtained within the above-mentioned range. However, the layer thickness may be increased to a level of 1,000 μm without any particular problem. On the secondary electrode layer 4 of aluminum thus obtained, a primary electrode layer 6 is partially formed by zinc, a zinc alloy or a zinc-aluminum pseudo alloy. When the primary electrode layer 6 is formed by a plate material, it may be attached by a suitable fixing method such as bolting. When the primary electrode layer 6 is formed by metal-spraying, the same method as used for forming the secondary electrode layer with aluminum, may be employed. The shape of the primary electrode layer 6 is not particularly limited. For example, it may be formed into a lattice-like continuous layer or independently scattered layers.

The primary electrode layer 6 may be applied over the entire surface of the secondary electrode layer 4. However, the secondary electrode layer 4 formed by metal-spraying of aluminum, is capable of conducting a uniform corrosion preventing current constantly for a long period of time, and it is usually preferred to form the primary electrode layer 6 so that the surface area of the primary electrode layer 6 will be from 5 to 70%, particularly from 10 to 50%, of the total surface area of the secondary electrode layer 4 of aluminum. The thickness of the primary electrode layer 6 is usually from 300 to 10,000 μm, preferably from 500 to 5,000 μm, in the case of a plate-like layer, and from 100 to 3,000 μm, preferably from 120 to 1,000 μm, in the case of a spray coating film.

The secondary electrode layer 4 thus formed and the reinforcing steel 2 will then be connected by an electrically conductive material 5 having the surface coated with an insulating material, whereby the primary electrode layer 6 on the secondary electrode layer 4 made of aluminum, serves as a primary electrode i.e. as a galvanic anode and electrically decomposed and corroded instead of iron, and consequently, the reinforcing steel 2 is electrolytically protected from corrosion. In order to prevent rusting of the metal spray coating layer in the first aspect of the invention or the primary electrode layer and the secondary electrode layer in the second aspect of the invention, a conventional corrosion preventing paint may be coated on the surface of such layers.

The method of the present invention is useful for all kinds of concrete structures containing reinforcing steel bars or steel frames. It is particularly useful for concrete structures susceptible to severe corrosion such as structures at sea shores, bridges and tunnels.

According to he method of the present invention, a spray coating metal film having excellent adhesion can be efficiently formed even on a vertical surface, a ceiling surface or a portion having a complex shape of a reinforced concrete structure, whereby a reinforced concrete structure excellent in the corrosion preventing property for a long period of time by an electrolytic protection (cathodic protection) by means of a galvanic anode method, can be obtained. Further, since a rough surface is formed by the primer coating on the surface of the reinforced concrete structure, it is unnecessary to make a rough surface of the reinforced concrete structure by blast treatment which has commonly been conducted prior to metal-spraying, whereby environmental pollution by a dust generated by such blast treatment can be prevented and the operational time required for such treatment can be saved.

Now, the present invention will be described in further detail with reference to Examples. However, it should be understood that the present invention is by no means restricted by such specific Examples.

Primer 275 g (volume of the solid resin content: 100 $cm^3$) of an epoxy-polyamide resin having 40% nonvolatile, which was prepared by dissolving 100 g of an epoxy resin (Epichlon 4051, trade name, manufactured by Dainippon ink and Chemicals, Inc.; epoxy equivalent: 950) in 80 g of xylene, 60 g of methyl ethyl ketone and 25 g of butanol and adding 10 g of a polyamide resin (Epicure 892, trade name, manufactured by Ceranese; active hydrogen equivalent: 133) thereto, and 221 g (volume of particles: 70 $cm^3$, PVC: 41%) of silicon carbide having an average particles size of 48 μm (green silicon carbide CG320, trade name, manufactured by Nagoya Kenmakizai Kogyo K.K.; specific gravity: 3.16) were thoroughly stirred to obtain a primer.

Reinforced concrete test specimen

A reinforced concrete test specimen (height×width ×length=100 mm×100 mm×400 mm) was used which was prepared by embedding a total of four deformed reinforcing steel bars, i.e. two bars in a covering depth of 20 mm and two bars in a covering depth of 30 mm, in concrete, and attaching a lead wire to the end of each steel bar.

The concrete was prepared by using normal Portland cement at a ratio of water/cement =60/40 (weight ratio) at a ratio of sand/concrete aggregate =54/46 (weight ratio) and in a unit amount of cement of 320 $kg/m^3$. To avoid an influence of the effects of the end portions, the end surfaces and part of side surfaces other than the surface on which a metal spray coating film was to be applied, were sealed by coating a solventless epoxy resin coating material thereon.

EXAMPLE 1

The surface of the reinforced concrete test specimen was cleaned by high pressure water washing. Then, the primer was coated thereon by an air spray in an amount of 50 $g/m^2$ and air dried for 2 hours to form a primer layer having a surface roughness (Rz) of 60 μm.

Then, a zinc wire material was metal-sprayed onto the primer layer by a flame-spraying machine (Type 11E, manufactured by Meteco Co.) to form a metal spray coating layer having a thickness of 130 μm. The metal spray coating layer was connected to the lead wires attached to the ends of steel bars and used as an anode.

EXAMPLE 2

In the same manner as in Example 1, a primer layer and a metal spray coating layer were formed on the surface of the reinforced concrete test specimen, and the metal spray coating layer was connected to the lead wires attached to the ends of the steel bars and used as an anode, except that a zinc-aluminum alloy (Zn/Al=72/28 (weight ratio)) wire material was used instead of the zinc wire material.

EXAMPLE 3

In the same manner as in Example 1, a primer layer was formed, and then a metal spray coating layer of a zinc-aluminum pseudo alloy (Zn/Al=72/28 (weight ratio)) having a thickness of 130 μm was formed on the primer layer by a reduced pressure arc spraying machine (PA-100, manufactured by Pan Art Craft Co.), and the metal spray coating layer was connected to the lead wires attached to the ends of the steel bars and used as an anode.

The metal-spraying was conducted by low temperature metal-spraying using a zinc wire and an aluminum wire each having a diameter of 1.3 mm at a wire conveying speed of 4 m/min at a voltage of 14 V at a current of 100 A under an air pressure of 5 kg/cm$^2$ at an air flow rate of 1 m$^3$/min at a spray distance of 20 cm.

COMPARATIVE EXAMPLE 1

In the same manner as in Example 1, a metal spray coating layer was formed on the surface of the reinforced concrete test specimen, and the metal spray coating layer was connected to the lead wires attached to the ends of the steel bars and used as an anode, except that the surface was roughened by sand blast treatment instead of forming a primer layer on the surface of the reinforced concrete test specimen.

COMPARATIVE EXAMPLE 2

In the same manner as in Example 2, a metal spray coating layer was formed on the surface of the reinforced concrete test specimen, and the metal spray coating layer was connected to the lead wires attached to the ends of the steel bars and used as an anode, except that the surface was roughened by sand blast treatment instead of forming a primer layer on the surface of the reinforced concrete test specimen.

COMPARATIVE EXAMPLE 3

A kerf having depth×width=10 mm×10 mm was formed in the longitudinal direction along the center portion on the surface of the reinforced concrete test specimen, and a zinc ribbon having a 5×5 mm cross section was embedded in the kerf. Then, the ribbon was connected to the lead wires attached to the ends of the steel bars and used as an anode. Further, an electrically conductive polymer cement mortar containing carbon fibers was coated in a thickness of 15 nun on the surface of the reinforced concrete test specimen to cover the ribbon, to obtain a test specimen of an in-kerf laying and coating method. With respect to test specimens obtained in Example 1 to 3 and Comparative Examples 1 to 3 and non-treated test specimens, a salt spray test (a salt water concentration of 5%) was conducted in accordance with JIS Z 2371 in a test apparatus at 35° C., and the measurements of the voltage (using a saturated calomel electrode), the current density (using a fine ampere meter) and the adhesive strength (using an elcometer) and inspection of the visual appearance were conducted immediately after the initiation of the test (referred to as "Initial" in Table 1), 500 hours later, 1500 hours later, 3000 hours later and 5000 hours later. The results are shown in Table 1.

It is apparent from Table 1 that as compared with Comparative Example 3 wherein a conventional in-kerf laying and coating method was used, Examples 1 to 3 wherein corrosion prevention was conducted by the method of the present invention, not only present excellent working efficiency but also exhibit equal or better corrosion preventing properties, and they are excellent also in the adhesive strength and the appearance. Especially Example 3 in which the zinc-aluminum pseudo alloy was formed, shows excellent performance. Comparative Examples 1 and 2 wherein blast treatment was conducted, were inferior in the adhesive strength as compared with Examples 1 to 3.

TABLE 1

| | Examples | | | Comparative Examples | | | Non-treated |
|---|---|---|---|---|---|---|---|
| | 1 | 2 | 3 | 1 | 2 | 3 | |
| | | | Measurement of voltage (mV) | | | | |
| Initial | −623 | −529 | −562 | −635 | −510 | −664 | −165 |
| 500 hr | −979 | −966 | −996 | −994 | −934 | −989 | −575 |
| 1500 hr | −750 | −930 | −951 | −548 | −903 | −957 | −566 |
| 3000 hr | −650 | −660 | −925 | −601 | −600 | −630 | −552 |
| 5000 hr | −610 | −620 | −902 | −605 | −575 | −510 | −535 |
| | | | Measurement of current density (mA/m$^2$) | | | | |
| Initial | 20.5 | 20.5 | 21.0 | 19.5 | 22.5 | 17.0 | — |
| 500 hr | 8.0 | 20.0 | 18.5 | 8.0 | 20.5 | 8.5 | — |
| 1500 hr | 7.0 | 11.5 | 10.5 | 3.0 | 11.0 | 8.0 | — |
| 3000 hr | 3.5 | 4.0 | 9.0 | 1.5 | 2.0 | 3.0 | — |
| 5000 hr | 1.0 | 1.5 | 8.5 | 0.5 | 0.5 | 1.0 | — |
| | | | Measurement of adhesive strength (kgf/cm$^2$) | | | | |
| Initial | 27 | 29 | 27 | 19 | 18 | 17 | — |
| 500 hr | 24 | 26 | 26 | 12 | 18 | 14 | — |
| 1500 hr | 25 | 26 | 27 | 9 | 13 | 14 | — |
| 3000 hr | 22 | 27 | 27 | 8 | 10 | 6 | — |
| 5000 hr | 18 | 25 | 26 | 5 | 7 | 5 | — |
| | | | Appearance | | | | |
| 500 hr | Good | Good | Good | Good | Good | Good | Good |
| 1500 hr | Good | Good | Good | Good | Good | Good | Good |
| 3000 hr | Metal spray coating layer lost about 10% | Good | Good | Metal spray coating layer lost about 30% | Metal spray coating layer lost about 10% | Mortar partially blistered, and cracking observed | Cracking and rusting observed |
| 5000 hr | Metal spray coating layer lost about 30% | Metal spray coating layer lost about 10% | GOod | Metal spray coating layer lost about 70% | Metal spray coating layer lost about 30% | Mortar entirely blistered, and cracking observed | Substantial cracking and rusting |

EXAMPLE 4

The surface of the reinforced concrete test specimen was cleaned by high pressure water washing. Then, the primer was coated thereon in an amount of 50 g/m$^2$ by an air spray and air dried for 2 hours to form a primer layer having a surface roughness (Rz) of 60 $\mu$m.

Then, an aluminum wire material was metal-sprayed on the primer layer by a flame-spraying machine (TYPE 11E, manufactured by Meteco Co.) to form a secondary electrode layer of aluminum having a thickness of 70 μm. The secondary electrode layer was connected to the lead wires attached to the ends of the steel bars. Then, three zinc plates (thickness×width×length=0.5 mm×20 mm×100 mm) were attached and bolted on the secondary electrode layer with a space from one another.

EXAMPLE 5

In the same manner as in Example 4, a secondary electrode layer of aluminum was formed. Then, a zinc wire material was metal-sprayed in a lattice pattern on the secondary electrode layer by a flame-spraying machine to form a primary electrode layer. The thickness of the primary electrode layer of zinc was 130 μm, and the total surface area was 20% relative to the total surface area of the secondary electrode layer of aluminum.

EXAMPLE 6

A test specimen was prepared in the same manner as in Example 5 except that a metal coating film of a zinc-aluminum pseudo alloy (zn/Al=72/28 (weight ratio)) was formed by using a reduced pressure arc spraying machine (PA-100, manufactured by Pan Art Craft Co.) instead of forming the primary electrode layer with a zinc spray coating film. The metal-spraying was conducted by low temperature metal-spraying using a zinc wire and an aluminum wire each having a diameter of 1.3 nun at a wire conveying speed of 4 m/min at a voltage of 14 V under a current of 100 A under an air pressure of 5 kg/cm$^2$ at an air flow rate of 1 m$^3$/min at a spray distance of 20 cm.

COMPARATIVE EXAMPLE 4

In the same manner as in Example 5, a secondary electrode layer of aluminum was formed and a primary electrode layer was formed by metal-spraying of zinc to obtain a test specimen except that the surface was roughened by sand blast treatment instead of forming a primer layer on the surface of the reinforced concrete test specimen.

COMPARATIVE EXAMPLE 5

In the same manner as in Example 6, a secondary electrode layer of aluminum was formed and a primary electrode layer of a zinc-aluminum pseudo alloy was formed to obtain a test specimen except that the surface was roughened by sand blast treatment instead of forming a primer layer on the surface of the reinforced concrete test specimen.

With respect to the test specimens obtained in Examples 4 to 6 and Comparative Examples 4 and 5, the test was conducted in the same manner as in Example 1. The results are shown in Table 2.

TABLE 2

| | Examples | | | Comparative Examples | |
|---|---|---|---|---|---|
| | 4 | 5 | 6 | 4 | 5 |
| | Measurement of voltage (mV) | | | | |
| Initial | −632 | −536 | −570 | −625 | −532 |
| 500 hr | −995 | −973 | −985 | −975 | −992 |
| 1500 hr | −966 | −927 | −963 | −733 | −910 |
| 3000 hr | −950 | −660 | −940 | −645 | −903 |
| 5000 hr | −918 | −620 | −912 | −610 | −637 |

TABLE 2-continued

| | Examples | | | Comparative Examples | |
|---|---|---|---|---|---|
| | 1 | 2 | 3 | 1 | 2 |
| | Measurement of current density (mA/m$^2$) | | | | |
| Initial | 20.5 | 20.5 | 21.0 | 19.5 | 22.5 |
| 500 hr | 19.0 | 20.0 | 18.5 | 9.5 | 20.5 |
| 1500 hr | 11.5 | 11.5 | 10.5 | 6.0 | 18.0 |
| 3000 hr | 9.5 | 4.0 | 9.0 | 1.5 | 10.5 |
| 5000 hr | 9.0 | 1.5 | 8.5 | 0.5 | 1.5 |
| | Measurement of adhesive strength (kgf/cm$^2$) | | | | |
| Initial | 27 | 29 | 27 | 19 | 18 |
| 500 hr | 27 | 26 | 26 | 12 | 18 |
| 1500 hr | 26 | 26 | 27 | 9 | 15 |
| 3000 hr | 26 | 27 | 27 | 8 | 13 |
| 5000 hr | 25 | 25 | 26 | 5 | 7 |
| | Appearance | | | | |
| 500 hr | Good | Good | Good | Good | Good |
| 1500 hr | Good | Good | Good | Good | Good |
| 3000 hr | Good | Good | Good | Primary electrode lost about 30% | Good |
| 5000 hr | Good | Primary electrode lost about 10% | Good | Primary electrode lost 70%, and secondary electrode partially peeled | Secondary electrode partially peeled |

It is evident form Table 2 that as compared with Comparative Example 3 wherein a conventional in-kerf laying and coating method was used, Examples 4 to 6 in which corrosion prevention was conducted by the method of the present invention not only present excellent workability but also exhibit equal or better corrosion preventing properties, and they are excellent also in the adhesive strength of the secondary electrode and the appearance. Especially, Example 6 wherein the zinc-aluminum pseudo alloy was formed, showed excellent performance.

Comparative Examples 4 and 5 wherein blast treatment was conducted, were inferior in the adhesive strength as compared with Examples 4 to 6.

We claim:

1. A method for preventing corrosion of a reinforced concrete structure having a reinforcing steel embedded therein, which comprises coating an aggregate-containing primer on the surface of the reinforced concrete structure, to form a primer layer having a rough surface, metal-spraying a metal having an ionization tendency larger than iron on the primer layer to form a metal spray coating layer, and connecting the metal spray coating layer and the reinforcing steel by an electrically conductive material.

2. The method for preventing corrosion of a reinforced concrete structure according to claim 1, wherein the metal spray coating layer formed on the primer layer is a layer of a zinc-aluminum pseudo alloy.

3. A method for preventing corrosion of a reinforced concrete structure having a reinforcing steel embedded therein, which comprises coating an aggregate-containing primer on the surface of the reinforced concrete structure, to form a primer layer having a rough surface, metal-spraying aluminum or an aluminum alloy on the primer layer to form a metal spray coating secondary electrode layer, forming a primary electrode layer of zinc, a zinc alloy or a zinc-aluminum pseudo alloy at least partially on the secondary electrode layer, and connecting the secondary electrode layer and the reinforcing steel by an electrically conductive material.

4. The method for preventing corrosion of a reinforced concrete structure according to claim 3, wherein the primary electrode layer is a zinc plate, a zinc-aluminum alloy plate, a metal spray coating film of zinc or a spray coating film of a zinc-aluminum pseudo alloy.

5. The method for preventing corrosion of a reinforced concrete structure according to claim 3 or 4, wherein the primary electrode layer has a surface area which is from 5 to 70% of the surface area of the secondary electrode layer.

* * * * *